US011571721B2

(12) United States Patent
Liu et al.

(10) Patent No.: US 11,571,721 B2
(45) Date of Patent: Feb. 7, 2023

(54) DRAINAGE SYSTEM FOR AUTOMATIC CLEANING STORAGE BASE OF ELECTRIC MOP

(71) Applicant: SHENZHEN JASHEN TECHNOLOGY CO., LTD., Shenzhen (CN)

(72) Inventors: Zhi-Chang Liu, Shenzhen (CN); Xiao-Ming Zhang, Shenzhen (CN); Jian-Xin Xi, Shenzhen (CN)

(73) Assignee: SHENZHEN JASHEN TECHNOLOGY CO., LTD., Shenzhen (CN)

( * ) Notice: Subject to any disclaimer, the term of this patent is extended or adjusted under 35 U.S.C. 154(b) by 770 days.

(21) Appl. No.: 16/560,427

(22) Filed: Sep. 4, 2019

(65) Prior Publication Data

US 2020/0405120 A1 Dec. 31, 2020

(30) Foreign Application Priority Data

Jun. 25, 2019 (CN) ..... 201910560001.4
Jun. 25, 2019 (CN) ..... 201910560059.9
(Continued)

(51) Int. Cl.
*A47L 13/51* (2006.01)
*A47L 13/20* (2006.01)
(Continued)

(52) U.S. Cl.
CPC ..... *B08B 3/041* (2013.01); *A47L 9/0063* (2013.01); *A47L 11/185* (2013.01); *A47L 11/292* (2013.01);
(Continued)

(58) Field of Classification Search
CPC ..... A47L 11/18; A47L 11/282; A47L 11/292; A47L 11/4002; A47L 11/4041;
(Continued)

(56) References Cited

U.S. PATENT DOCUMENTS 11,096,544 B2 * 8/2021 Nguyen ..... A47L 11/292
2019/0254495 A1 * 8/2019 Zhang ..... A47L 11/24
(Continued)

FOREIGN PATENT DOCUMENTS

CN 202913481 U * 5/2013

*Primary Examiner* — Marc Carlson
(74) *Attorney, Agent, or Firm* — Muncy, Geissler, Olds & Lowe, P.C.

(57) ABSTRACT

Disclosed is a drainage system for an automatic cleaning storage base of an electric mop. The automatic cleaning storage base of the electric mop comprises a casing member having a cleaning tank. The drainage system comprises a drain valve; an outlet end of the drain valve is connected to the outside of the casing member, and an inlet end of the drain valve is connected to the cleaning tank; the drain valve has a switch, and the switch is provided with a first rack; the drain valve is further provided with a duplex gear and a second rack; the duplex gear has a gear portion with a larger outer diameter to mesh with the first rack, and the duplex gear has a gear portion with a smaller outer diameter to mesh with the second rack.

4 Claims, 6 Drawing Sheets

(30) Foreign Application Priority Data

Jun. 26, 2019 (CN) ..... 201910564423.9
Jun. 26, 2019 (CN) ..... 201910565112.4
Jun. 26, 2019 (CN) ..... 201910566387.X

(51) Int. Cl.

| | |
|---|---|
| ***B08B 3/04*** | (2006.01) |
| ***A47L 11/292*** | (2006.01) |
| ***A47L 13/22*** | (2006.01) |
| ***A47L 13/58*** | (2006.01) |
| ***B08B 1/00*** | (2006.01) |
| ***B08B 1/02*** | (2006.01) |
| ***A47L 13/50*** | (2006.01) |
| ***A47L 9/00*** | (2006.01) |
| ***A47L 13/24*** | (2006.01) |
| ***A47L 11/40*** | (2006.01) |
| ***A47L 11/18*** | (2006.01) |

(52) U.S. Cl.

CPC ..... *A47L 11/408* (2013.01); *A47L 11/4016* (2013.01); *A47L 13/20* (2013.01); *A47L 13/22* (2013.01); *A47L 13/24* (2013.01); *A47L 13/50* (2013.01); *A47L 13/51* (2013.01); *A47L 13/58* (2013.01); *B08B 1/005* (2013.01); *B08B 1/007* (2013.01); *B08B 1/02* (2013.01); *A47L 11/18* (2013.01)

(58) Field of Classification Search

CPC ..... A47L 11/4075; A47L 11/4088; A47L 11/4091; A47L 13/20; A47L 13/22; A47L 13/24; A47L 13/50; A47L 13/51; A47L 13/58; A47L 9/0063; B08B 1/005; B08B 1/007; B08B 1/02; B08B 3/041

See application file for complete search history.

(56) References Cited

U.S. PATENT DOCUMENTS

2020/0077858 A1* 3/2020 Zhang ..... A47L 11/4061
2020/0107693 A1* 4/2020 Zhang ..... B08B 3/10

* cited by examiner

DRAINAGE SYSTEM FOR AUTOMATIC CLEANING STORAGE BASE OF ELECTRIC MOP

BACKGROUND OF THE INVENTION

1. Technical Field

The present invention relates to a mop, and more particularly to a drainage system for an automatic cleaning storage base of an electric mop.

2. Description of Related Art

The mop is a common household cleaning tool that mainly includes a mop rod for holding and a mop head for cleaning. With the advancement of technology, many more motorized and even intelligent mops have been introduced.

The direct cleaning of the mop relies on a cleaning part on the mop head. According to different designs, the cleaning part may be cloth strips and may be a sponge roller. The traditional mop head has a problem in use, that is, the cleaning problem of the mop head and the cleaning part after cleaning the floor. In the prior art, the mop head and the cleaning part are mostly washed manually, which causes troublesome operation and stains the human hands. The drainage system is very convenient to use.

BRIEF SUMMARY OF THE INVENTION

In view of the problem in the prior art that the mops are mostly scrubbed manually, which causes troublesome operation and stains the human hands, the present invention provides a drainage system for discharging dirty water by driving a drain valve. The drainage system is simple to operate and convenient to use.

To achieve the above-mentioned objective, the present invention provides a drainage system of an automatic cleaning storage base of an electric mop. The automatic cleaning storage base of the electric mop comprises a casing member having a cleaning tank. The drainage system here comprises a drain valve; an outlet end of the drain valve is connected to the outside of the casing member, and an inlet end of the drain valve is connected to the cleaning tank; the drain valve has a switch, and the switch is provided with a first rack; the drain valve is further provided with a duplex gear and a second rack; the duplex gear has a gear portion with a larger outer diameter to mesh with the first rack, and the duplex gear has a gear portion with a smaller outer diameter to mesh with the second rack. According to the invention, sewage in the cleaning tank is drained by arranging the drain valve, and a gear-rack structure is used as a special switch driving structure for the drain valve to open the drain valve and help drainage. The drainage system is easy to operate and achieves a good effect.

Preferably, the drain valve is provided with an auxiliary setting base, and the first rack, the second rack and the duplex gear are all disposed on the auxiliary setting base.

Preferably, the first rack is disposed axially along the drain valve, and the second rack is perpendicular to the first rack.

Preferably, the upper end of the second rack is connected with a button.

Preferably, the outlet end of the drain valve is connected with a drain pipe.

Preferably, the drain valve is a spring one-way valve.

Preferably, the cleaning tank is provided with a positioning groove for placing the electric mop.

Preferably, the decontamination assembly comprises a squeezing scraper strip, and the squeezing scraper strip is disposed at an edge of the positioning groove.

Preferably, the cleaning tank is formed by recessing the upper portion of the casing member, and the casing member is bent to form a cavity below.

Preferably, the bottom surface of the cleaning tank is an inclined surface.

Detailed constructions or features provided in the present invention will be described in the detailed description of the following embodiments. However, those skilled in the art should understand that the detailed description and the specific embodiments of the present invention are intended to be illustrative of the invention and not to limit the scope of the invention.

DETAILED DESCRIPTION OF THE INVENTION

The technical content and features of the present invention will be described in detail below by referring to the preferred embodiments and the drawings. The present invention is mainly applied to an electric mops and wet type electric mops, and those skilled in the art can understand that the description terms of the embodiments are generic description of which the application field is not limited; for example, material or shape terms include but are not limited to the materials or shapes specified by the description, and the positional terms include but are not limited to "arrange", "close to", "connect", or "abut". The word "one" for indicating the number of components means one and more than one component. The directional expressions such as "upper", "lower", "inside", "outside", "top" and "bottom" mentioned in the contents of the description are merely illustrative terms based on the normal use direction, not intended to limit the scope of the claims.

Figure 1:
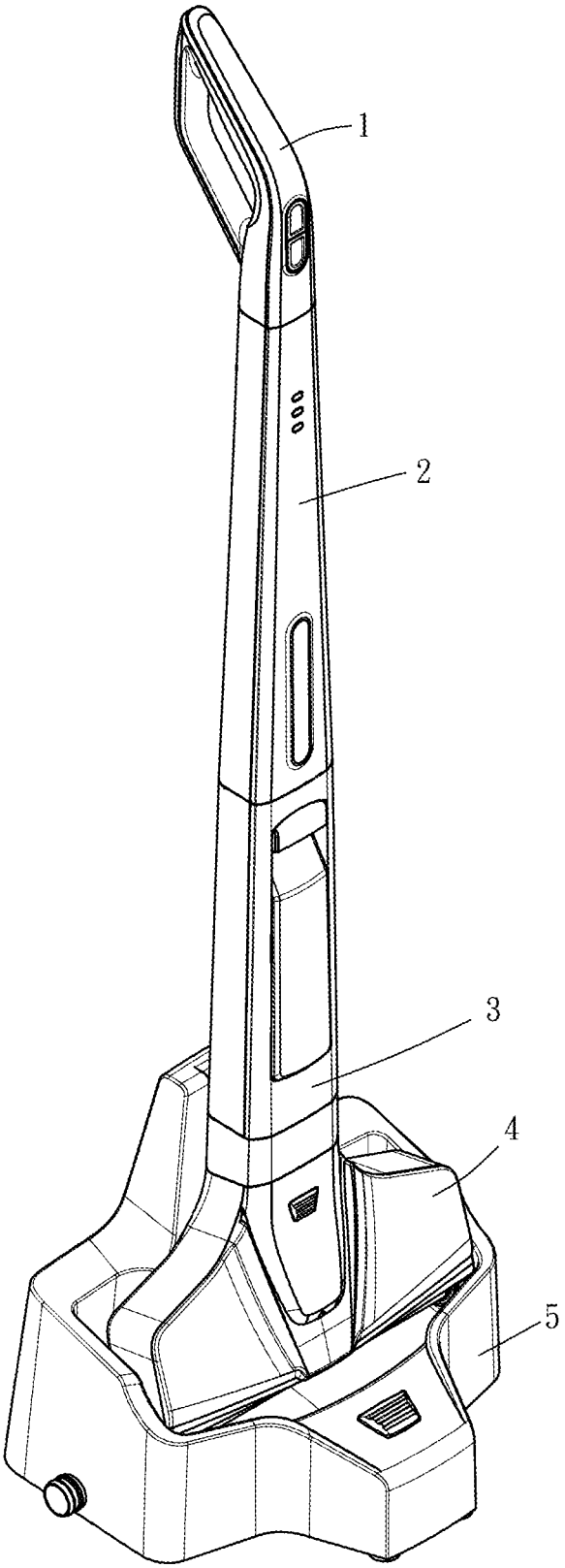
FIG. 1 is an assembled perspective view of a preferred embodiment of the present invention.
Figure 2:
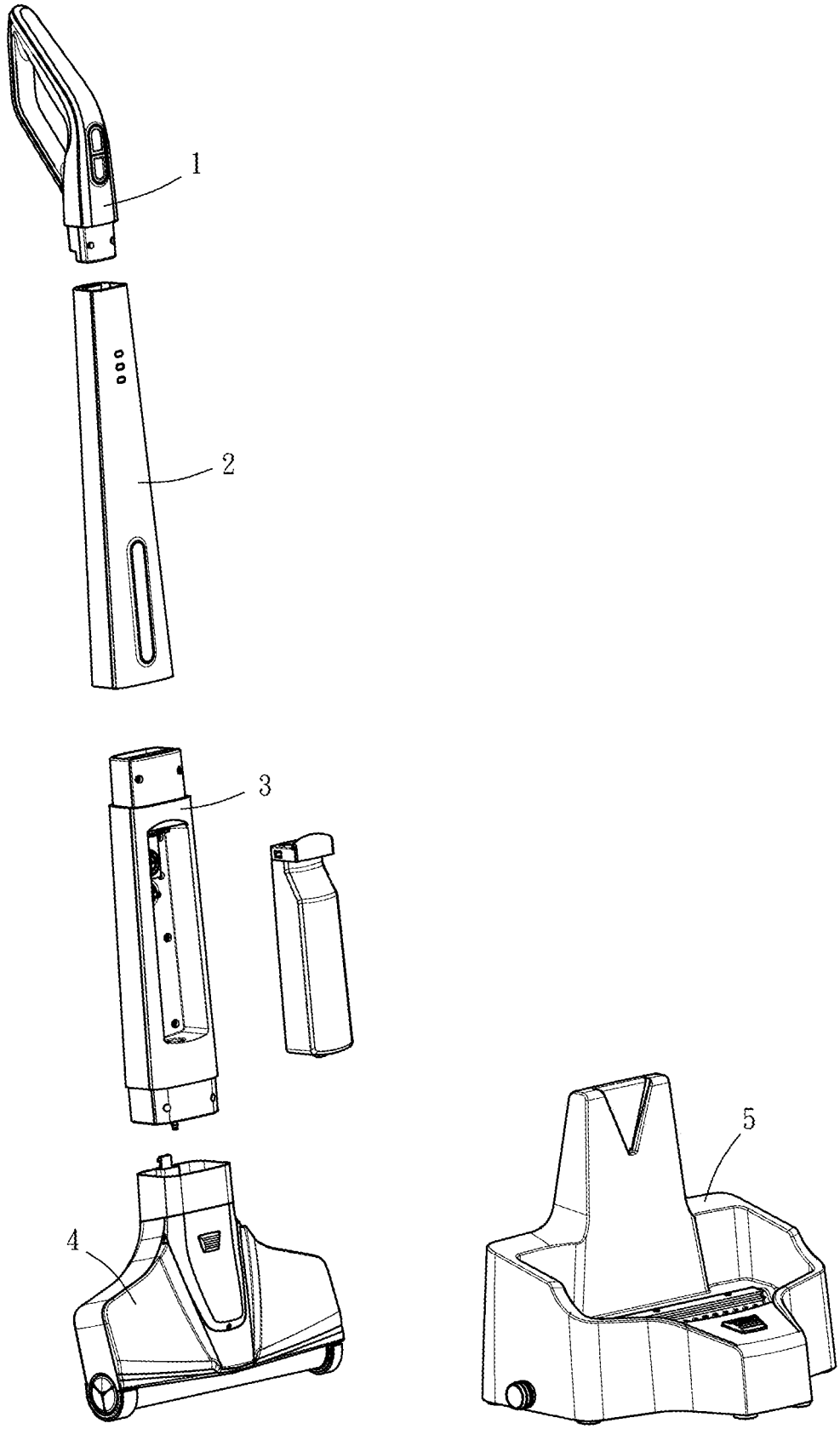
FIG. 2 is an exploded perspective view of a preferred embodiment of the present invention.

As shown in FIG. 1 and FIG. 2, an automatic cleaning mop comprises: a mop rod assembly having a handle segment assembly 1, an upper rod assembly 2, and a lower rod assembly 3; a mop head assembly 4; and a cleaning base assembly 5; the mop head assembly 4 is disposed at the lower end of the mop rod assembly, and the cleaning base assembly 5 is used for placing and cleaning the mop head assembly 4.

Figure 3:
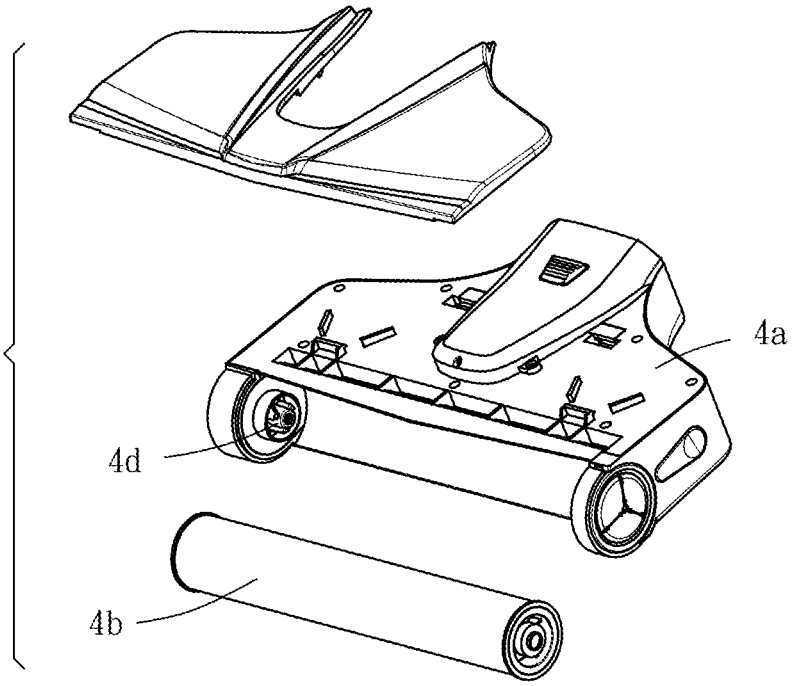
FIG. 3 is a partial exploded perspective view of a preferred embodiment of the present invention, showing the exploded structure of a mop head assembly.
Figure 4:
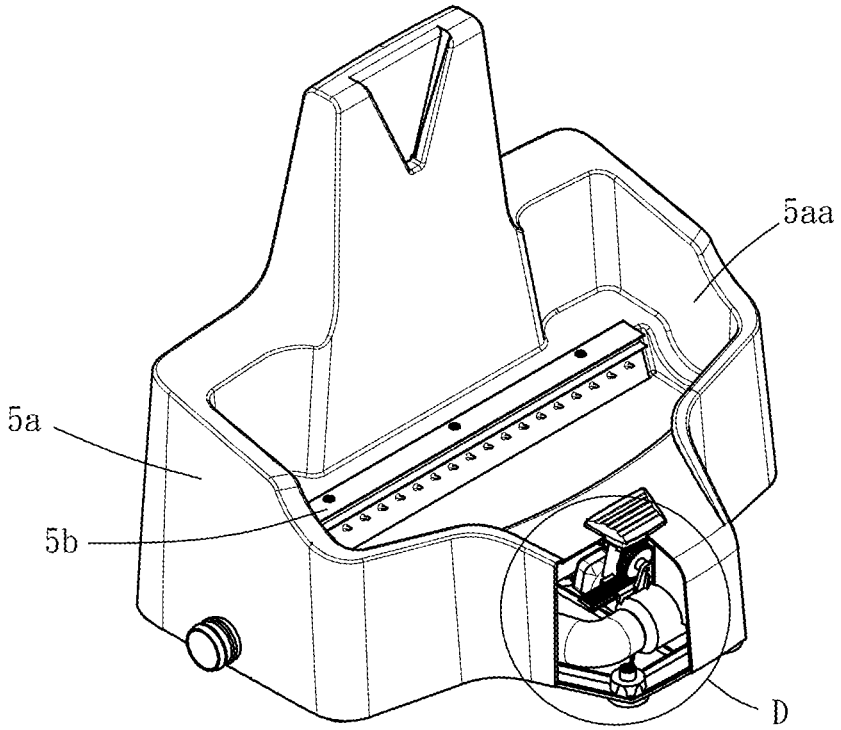
FIG. 4 is a schematic view of a cleaning base assembly according to a preferred embodiment of the present invention.
Figure 5:
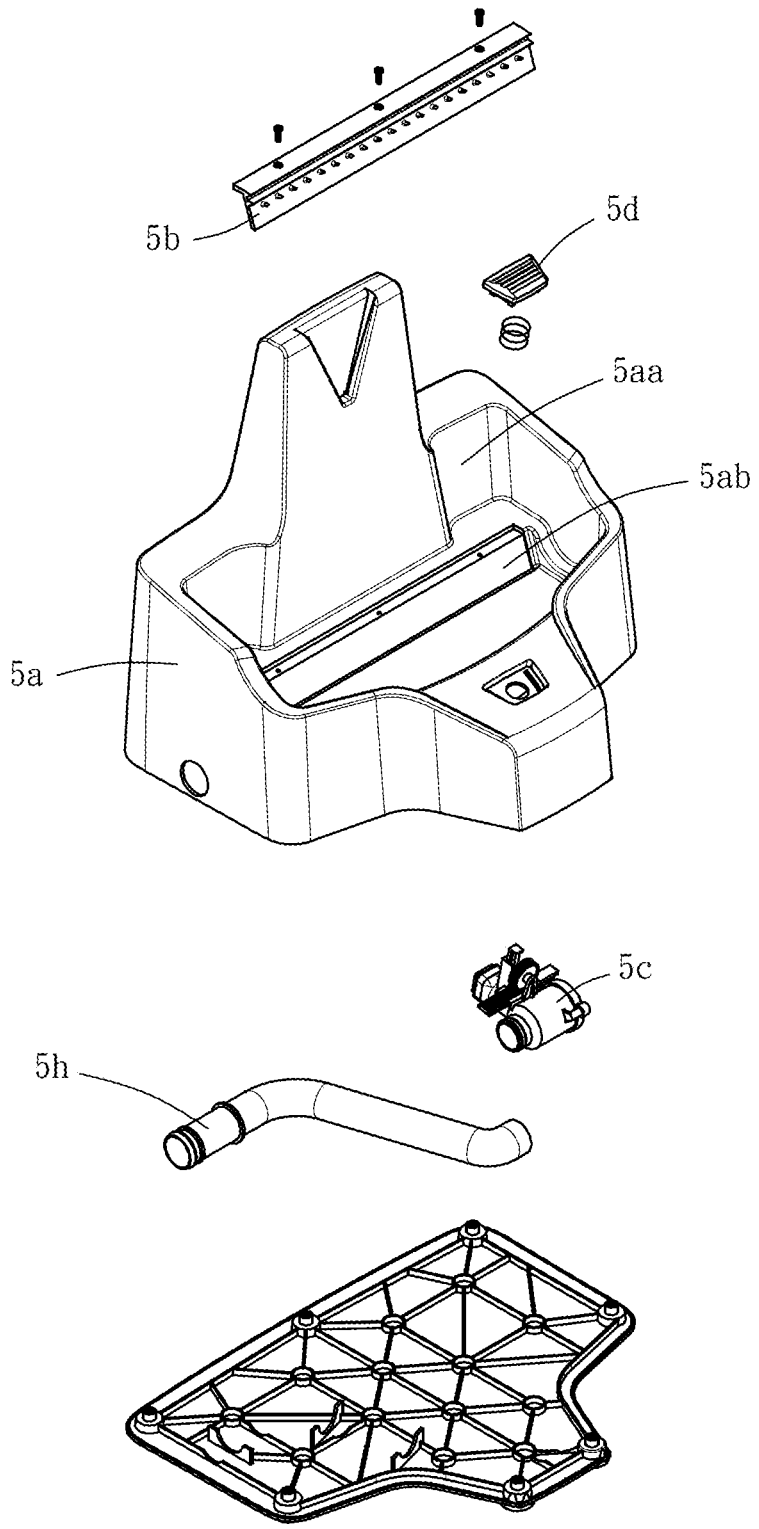
FIG. 5 is an exploded perspective view of a cleaning base assembly according to a preferred embodiment of the present invention.
Figure 6:
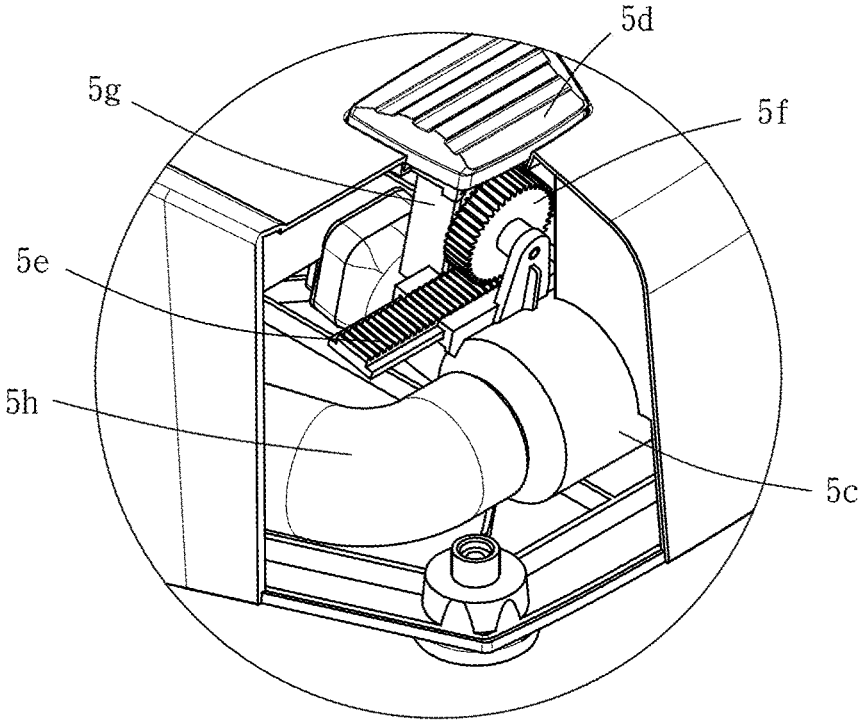
FIG. 6 is an enlarged schematic view of a portion D of FIG. 4.
Figure 7:
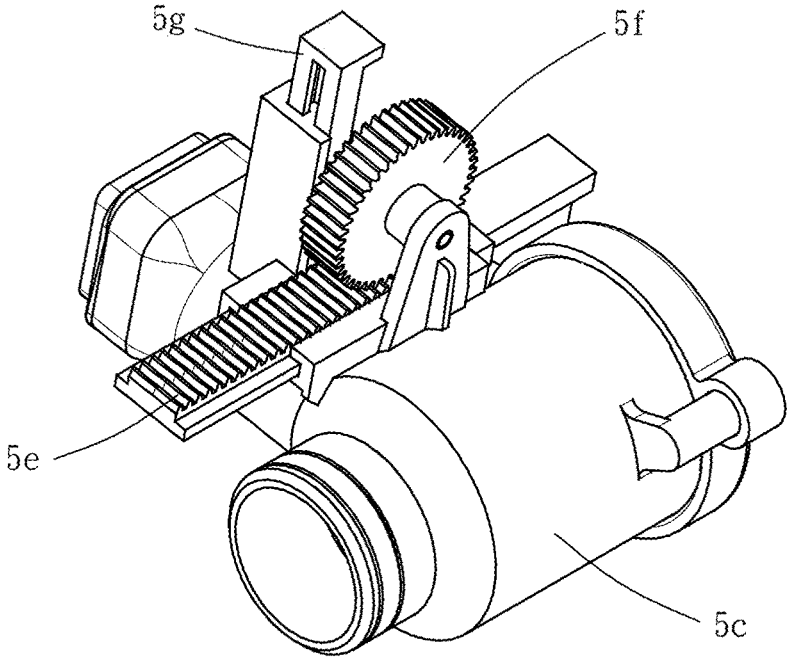
FIG. 7 is a schematic view of a drain valve of a cleaning base assembly according to a preferred embodiment of the present invention.
Figure 8:
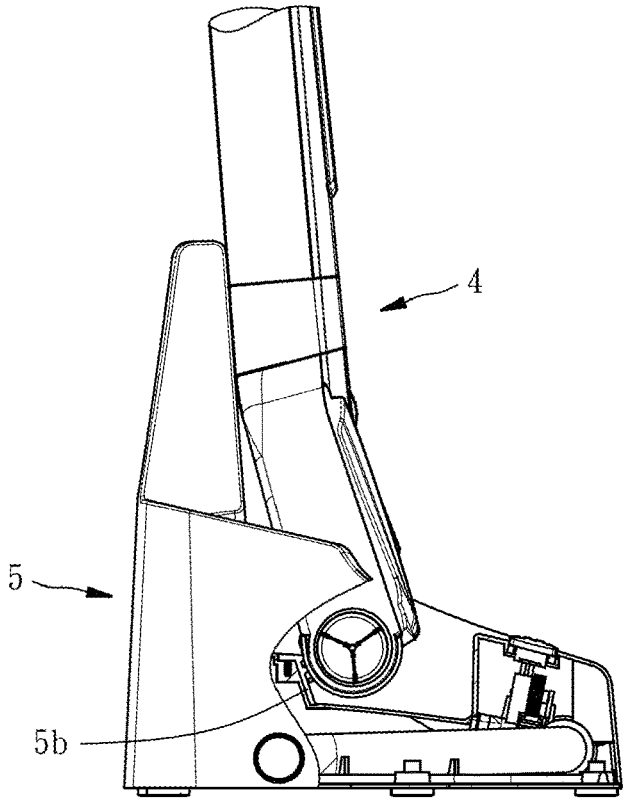
FIG. 8 is a schematic view of the combined arrangement of the cleaning base assembly and the mop head assembly according to a preferred embodiment of the present invention.
Figure 9:
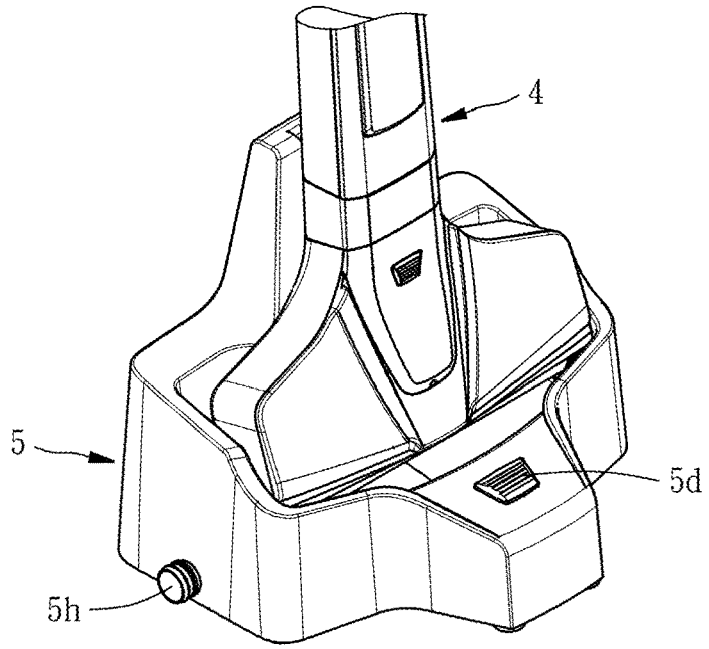
FIG. 9 is another schematic view of the combined arrangement of the cleaning base assembly and the mop head assembly according to a preferred embodiment of the present invention.

As shown in FIG. 3, FIG. 4 and FIG. 5, the mop head assembly 4 has a mop head housing 4*a* on which a rotatable cleaning roller 4*b* is disposed. Preferably, the mop head housing 4*a* is internally provided with a motor for driving the cleaning roller 4*b*, and the motor is connected to the cleaning roller 4*b* through a transmission mechanism assembly. Preferably, the transmission mechanism assembly comprises a change gear set, a drive belt and a roller connector 4*d*; the motor 4*c*, the change gear set, the drive belt and the roller connector 4*d* are sequentially connected; the roller connector 4*d* is rotatably disposed on the mop head housing 4*a*; and the cleaning roller 4*b* is fitted to the roller connector 4*d*. Preferably, one end of the roller connector 4*d* is correspondingly connected to a pulley of the drive belt at one end, the roller connector 4*d* is fitted at the other end, and the roller connector 4*d* is mounted on the mop head housing 4*a* by a bearing.

As shown in FIG. 4 to FIG. 7 the cleaning base assembly 5 has a casing member 5*a*; a cleaning tank 5*aa* is formed in an upper surface of the casing member; a decontamination assembly for scrubbing the mop is disposed in the cleaning tank 5*aa*, and the housing member 5*a* is provided with a drainage system for discharging sewage. Preferably, a positioning groove 5*ab* for placing the mop head is disposed in the cleaning tank 5*aa*. Preferably, the decontamination assembly comprises a squeezing scraper strip 5*b*, and the squeezing scraper strip 5*b* is disposed at an edge of the positioning groove 5*ab*. Preferably, the drainage system comprises a drain valve 5*c*, an water inlet end of the drain valve 5*c* is connected into the cleaning tank 5*aa*, a water outlet end of the drain valve Sc is connected to the outside of the casing member 5*a*, and a button 5*d* for starting the drain valve 5*c* is disposed on the casing member 5*a*.

The specific structural form of the cleaning base assembly 5 is given in this embodiment, wherein the casing member 5*a* is the body of the cleaning base assembly 5, and the cleaning tank 5*aa* is used for containing water for cleaning the mop. The decontamination assembly is used to help the roller on the mop to discharge the adsorbed sewage. In the specific implementation, in order to naturally discharge sewage out of the cleaning tank 5*aa*, the bottom surface of the cleaning tank 5*aa* is set as an inclined surface to facilitate the natural flowing and drainage of the sewage. The casing member 5*a* is integrally formed; therefore, as shown in the figure, the cleaning tank 5*aa* is formed by recessing downward the whole upper plate surface of the casing member 5*a*, and correspondingly the positioning groove 5*ab* is also formed by entirely recessing the casing member 5*a*. Through the bending of the main plate surface of the casing member 5*a*, a cavity is naturally formed underneath it for arranging the relevant components of the drainage system.

Preferably, the drainage system comprises a drain valve 5*c*, an water inlet end of the drain valve 5*c* is connected into the cleaning tank 5*aa*, and a water outlet end of the drain valve 5*c* is connected to the outside of the casing member 5*a*. Preferably, a button 5*d* for starting the drain valve 5*c* is disposed on the casing member 5*a*. Preferably, a switch of the drain valve Sc is provided with a first rack Se for starting the switch; the valve body of the drain valve 5*c* is further provided with a duplex gear 5*f* and a second rack 5*g*; the duplex gear 5*f* has a gear portion with a larger outer diameter to mesh with the first rack Se, the duplex gear has a gear portion with a smaller outer diameter to mesh with the second rack 5*g*, and the second rack 5*g* is connected to the button 5*d*. Preferably, a return spring for returning the button 5*d* is further disposed between the button 5*d* and the casing member 5*a*. Preferably, the water outlet end of the drain valve 5*c* is connected to a drain pipe 5*h*, and the drain pipe 5*h* is connected to the outside of the casing member 5*a*.

The drainage system is used to discharge the sewage out of the cleaning tank 5*aa*, which is specifically controlled by the drain valve 5*c*. The drain valve 5*c* is connected into the cleaning tank 5*aa* at one end and connected to the outside of the casing member 5*a* at the other end; the drain valve 5*c* is opened to discharge the sewage, and the drain valve 5*c* is closed to stop the discharge of the sewage. In the above embodiments, as a preferred solution, the button 5*d* is pressed down to drive the second rack 5*g*, the second rack 5*g* then drives the duplex gear 5*f* to rotate, the duplex gear 5*f* drives the first rack Se to move, and the switch of the drain valve 5*c* is opened by the movement of the first rack Se. Based on this, the drain valve 5*c* may be a spring one-way valve, and the returning of the action of opening the valve is realized by using a spring of the spring one-way valve, that is, when the pressure on the button 5*d* is removed, under the action of the spring of the spring one-way valve, the valve flap in the valve returns back to drive the switch of the valve to return back, thereby causing the first rack Se, the duplex gear 5*f* and the second rack 5*g* to move in the opposite direction, and further realizing the reverse return of the above-mentioned related components. The drain valve 5*c* is connected to the outside of the casing member 5*a* through the drain pipe 5*h*, which is advantageous for the drainage effect.

What is claimed is:

1. A drainage system of an automatic cleaning storage base of an electric mop, the automatic cleaning storage base of the electric mop comprising a casing member having a cleaning tank, wherein the drainage system comprises a drain valve; an outlet end of the drain valve is connected to the outside of the casing member, and an inlet end of the drain valve is connected to the cleaning tank; the drain valve has a switch, and the switch is provided with a first rack; the drain valve is further provided with a duplex gear and a second rack; the duplex gear has a gear portion with a larger outer diameter to mesh with the first rack, and the duplex gear has a gear portion with a smaller outer diameter to mesh with the second rack, wherein the drain valve is provided with an auxiliary setting base, and the first rack, the second rack and the duplex gear are all disposed on the auxiliary setting base, and wherein the first rack is disposed axially along the drain valve, and the second rack is perpendicular to the first rack.

2. The drainage system of an automatic cleaning storage base of an electric mop according to claim 1, wherein the upper end of the second rack is connected with a button.

3. The drainage system of an automatic cleaning storage base of an electric mop according to claim 1, wherein the outlet end of the drain valve is connected with a drain pipe.

4. The drainage system of an automatic cleaning storage base of an electric mop according to claim 1, wherein the drain valve is a spring one-way valve.

* * * * *